US005308702A

United States Patent [19]

Furukimi et al.

[11] Patent Number: 5,308,702

[45] Date of Patent: May 3, 1994

[54] IRON-BASED POWDER COMPOSITION FOR USE IN POWDER METALLURGY, PROCESS FOR ITS PRODUCTION AND PROCESS FOR PRODUCING IRON-BASE SINTERED MATERIAL

[75] Inventors: Osamu Furukimi; Koji Yano, both of Chiba; Shigeaki Takajo, Tokyo, all of Japan

[73] Assignee: Kawasaki Steel Corporation, Japan

[21] Appl. No.: 827,343

[22] Filed: Jan. 29, 1992

[30] Foreign Application Priority Data

Sep. 5, 1991 [JP] Japan ..... 3-225443

[51] Int. Cl.[5] ..... B22F 1/00; B32B 15/02

[52] U.S. Cl. ..... 428/403; 75/252; 428/407; 428/570

[58] Field of Search ..... 428/403, 407, 570; 75/252

[56] References Cited

U.S. PATENT DOCUMENTS

| | | | |
|---|---|---|---|
| 3,991,240 | 11/1976 | Harrington et al. | 428/403 |
| 4,483,905 | 11/1984 | Engstrom | 428/570 |
| 4,578,114 | 3/1986 | Rangaswamy et al. | 75/252 |
| 4,578,115 | 3/1986 | Harrington et al. | 428/570 |
| 4,834,800 | 5/1989 | Semel | 428/570 |

FOREIGN PATENT DOCUMENTS

| | | |
|---|---|---|
| 57-164901 | 10/1982 | Japan . |
| 61-231102 | 10/1986 | Japan . |
| 137102 | 6/1988 | Japan . |
| 2-97602 | 4/1990 | Japan . |

*Primary Examiner*—Paul J. Thibodeau
*Assistant Examiner*—D. S. Nakarani
*Attorney, Agent, or Firm*—Austin R. Miller

[57] ABSTRACT

Improved iron-base powder composition for use in powder metallurgy comprising an iron-base powder to the surfaces of the particles of which either an Fe-Ni powder alloy containing 5–70 wt % Ni or an Fe-Mo alloy powder containing 20–70 wt % Mo or both alloy powders is adhered means of a binder or binders. This iron-base powder composition can be obtained by a process in which either an Fe-Ni alloy powder containing 5–70 wt % Ni or an Fe-Mo alloy powder containing 20–70 wt % Mo or both alloy powders is adhered by thermally melting a binder. The thus obtained iron-base powder composition can be shaped and sintered to produce an iron-base sintered material. The iron-base powder composition is suitable for use in the powder metallurgical manufacture of iron-base sintered parts that require high density, high strength, toughness, wear resistance and good dimensional change stability.

5 Claims, No Drawings

IRON-BASED POWDER COMPOSITION FOR USE IN POWDER METALLURGY, PROCESS FOR ITS PRODUCTION AND PROCESS FOR PRODUCING IRON-BASE SINTERED MATERIAL

FIELD OF THE INVENTION

This invention relates to an iron-base powder composition for use as a feed in the powder metallurgical manufacture of iron-base sintered parts where high density, high strength, high toughness, high wear resistance and good dimensional change stability are required. This invention also relates to a process for producing said iron-base powder composition, as well as a process for manufacturing iron-base sintered materials using said powder composition. The iron-base powder composition and the iron-base sintered materials manufactured by the said powder composition are extensively used as sintered parts such as gear wheels, sprockets and synchronizer hubs in automobiles, industrial machines, office automation equipment, etc.

Iron-base sintered materials have heretofore been used extensively in automotive parts and other applications. Recently, a need has arisen to provide those parts with higher strength and wear resistance. In order to provide higher strength, it has been proposed that an alloy including a higher content of alloying elements which would improve strength and wear-resistance be used as taught in Japanese Patent Application (kokai) No. 231102/1986 or that optimization of alloying elements be effected as disclosed in Japanese Patent Application (kokai) No. 164901/1982. These techniques are very effective for the purpose of providing higher strength and they can be applied to strength parts.

Alloying elements that are commonly added to obtain high-strength iron-base sintered materials are C, Cu, Ni and Mo. Carbon (C) is usually incorporated by mixing a graphite powder with a feed powder mixture. Since C diffuses into Fe with satisfactory rapidity during sintering, this mixing method suffices for achieving reasonably uniform alloying.

Other alloying elements such as Cu, Ni and Mo can be added by simply mixing an alloying element in powder form with an iron-base powder or by preparing a prealloyed steel powder having an alloying element incorporated in a steel powder.

Copper (Cu), Ni and Mo don't diffuse as fast as C, so prealloying those elements uniformly into the feed powder is advantageous for insuring that they will be distributed uniformly in the sintered parts. However, this approach has the problem that the compressibility of the feed powder (prealloyed steel powder) will decrease, thereby making it difficult to obtain a sintered material of high density.

In the "simple mixing" method in which an alloying element is mixed in powder form with an iron-base powder, it is common practice that a metal powder, a graphite powder, an iron phosphide powder and a cutting property improving powder are added, as required, to a pure iron powder or an alloy steel powder which are iron-base powders for use in powder metallurgy, followed by the mixing of a lubricant such as zinc stearate with a mixer. However, this approach has the following problems.

First, the feed mixture prepared by the "simple mixing" method is prone to segregation. The powder mixture contains particles of different shapes and densities, so segregation will easily occur in post-mixing stages such as transportation, charging into a hopper, delivery therefrom and the shaping operation. For example, it is well known that a mixture of an iron-base powder and a graphite powder experiences segregation in the container on account of vibrations that occur during transportation on a truck, with the resulting bleed-out of the graphite powder. It is also known that the concentration of graphite powder differs in three phases (initial, middle and last) of delivery from the hopper. In each of these cases of segregation, unevenness occurs in the composition of the final product and it will experience such a great dimensional change stability and nonuniformity in strength that it will be rejected as an unacceptable product. Further, the graphite powder and other additives are all comprised of fine particles, so they will increase the specific surface area of the mixture, which will then become lower in flowability. This drop in the flowability of the powder mixture will lower the speed of packing into a shaping mold, thereby reducing the production rate of compacts.

Under the circumstances, partially alloyed steel powders having a fine Cu, Ni or Mo powder partly diffused and adhered to the particles of an Fe-base powder are used with particular preference. Such partially alloyed steel powders have high compressibility and are capable of producing sintered parts that have a comparatively uniform distribution of alloying elements. However, this approach is economically very disadvantageous compared to the "simple mixing" method since the production of the steel powders contains a step of diffusion treatment.

However, the sintered parts produced from such partially alloyed powders are not completely uniform in the distribution of alloying elements and the present inventors have recently found that this incomplete uniformity can enhance, rather than deteriorate, the strength of the sintered parts. Stated more specifically, sintered parts having a reasonably nonuniform distribution of Ni and Mo concentrations contains a Ni- and Mo-rich austenitic phase and, when the sintered parts are deformed, that phase transformes to a fine martensite phase (i.e., strain-induced martensite transformation), imparting high strength to the sintered parts.

The present inventors previously disclosed in Japanese Patent Application (kokai) No. 97602/1990 a Ni- or Mo-containing partially alloyed steel powder for use in the manufacture of such high-strength sintered materials. However, this approach has had the problem that the resulting partially alloyed powder is costly. Further, in order to adjust the Ni and Mo distributions of the sintered parts so that it will have a higher strength, the state of diffusion and adhesion of Ni and Mo in the partially alloyed steel powder has to be controlled properly and this has reduced the latitude in selection of the Ni and Mo materials and diffusing conditions, occasionally causing nonuniformity in strength.

Some sintered materials require high wear resistance in addition to high strength. However, in order to achieve improvement in wear resistance, suitable alloying elements such as Cr and W have to be added in large amounts, which is also disadvantageous from an economic viewpoint.

SUMMARY OF THE INVENTION

The present invention has been attained under these circumstances and has an object of solving the aforementioned problems of the prior art (i.e., the high cost of the partially alloyed powders, as well as nonuniformity in the dimensional change stability and in strength that occur in the "simple mixing" method on account of the formation of a nonuniform layer) and providing an iron-base powder composition that is capable of yielding sintered parts characterized by easy reinforcement through strain-induced martensite transformation, high wear resistance and good dimensional change stability.

Another object of the present invention is to provide a process for producing said improved iron-base powder composition.

A further object of the present invention is to provide a process for producing sintered parts using said iron-base powder composition.

According to its first aspect, the present invention provides an iron-base powder composition for use in powder metallurgy comprising an iron-base powder to the surface of the particles of which either an Fe- Ni alloy powder containing 5–70 wt % Ni or an Fe-Mo alloy powder containing 20–70 wt % Mo or both alloy powders are adhered by means of a binder or binders.

According to its second aspect, the present invention provides a process for producing an iron-base powder composition for use in powder metallurgy, comprising the step of adhering either an Fe-Ni alloy powder containing 5–70 wt % Ni or an Fe-Mo alloy powder containing 20–70 wt % Mo or both alloy powders to the surface of the particles of an iron-base powder by thermally melting a binder.

According to its third aspect, the present invention provides a process for producing an iron-base sintered material further comprising the steps of forming said iron-base powder composition to a predetermined shape and sintering the shaped body.

The iron-base powder to which an Fe-Ni alloy powder and/or an Fe-Mo alloy powder are to be adhered may be of any type such as a pure iron powder, a Cr containing alloy steel powder, a Cr-Mn containing alloy steel powder, etc., from which an appropriate type is selected depending on the object. The Cr- or Cr-Mn containing alloy steel powders preferably contain 0.08–5.0 wt % Cr and 0.1–0.8 wt % Mn.

The binder is preferably thermally melted at 80°–150° C.

DETAILED DESCRIPTION OF THE INVENTION

The present invention will now be described below in more detail. The present inventors found that sintered parts of high density, high strength, good dimensional change stability and high wear resistance could be obtained by using an iron-base powder composition that was prepared not by the conventional method of mixing a pure Ni and/or Mo powder, but by having an Fe-Ni alloy powder and/or an Fe-Mo alloy powder adhered to the surface of the particles of an iron-base powder by means of a binder or binders. The sintered parts of the type contemplated by the present invention contains 1–10% Ni and/or 0.5–10% Mo (all percentages that appear hereinafter are on a weight basis), usually with the addition of 0.2–1.0% C. The effectiveness of the present invention is basically the same even if other alloying elements such as Cu, P and W are included. The Ni and Mo contents of the sintered parts are preferably within the ranges of 1–10% and 0.5–10%, respectively. If their contents are less than the lower limits, Ni and Mo are not effective in improving the strength and wear resistance of the sintered parts. If their contents are greater than the upper limits, excess austenite will form to deteriorate the mechanical properties of the sintered parts.

The present invention is characterized by using an iron-base powder composition comprising an iron-base powder to the surface of the particles of which either an Fe-Ni alloy powder containing 5–70% Ni or an Fe-Mo alloy powder containing 20–70% Mo or both alloy powders are adhered as a Ni and/or a Mo source by means of a binder or binders. Using this iron-base powder composition, Ni- and/or Mo- containing iron-base sintered materials can be produced that are characterized by high density, high strength, good dimensional change stability and high wear resistance.

The most important condition to be satisfied for producing sintered parts of high strength is creating an appropriate Ni- or Mo-rich austenitic phase in the sintered parts. If the amount of the austenitic phase or the concentrations of Ni and Mo in that phase are too high, an excess of the austenitic phase will remain untransformed to martensite even if the sintered parts are deformed and the resulting decrease in strength is unavoidable. Therefore, the critical part of the present invention is to select the Ni and Mo sources in powder form in such a way that an appropriate Ni- or Mo-rich austenitic phase will be produced in the sintered parts.

In accordance with the present invention, the Fe-Ni alloy powder and/or the Fe-Mo alloy powder are adhered to the surface of the particles of the iron-base powder by means of a binder or binders; as a result, the Fe-Ni alloy powder and/or the Fe-Mo alloy powder and the graphite powder are dispersed uniformly in the sintered parts, thereby suppressing the occurrence of segregation while reducing possible nonuniformity in the composition of the final product. Consequently, the dimensional change stability of the sintered parts is improved. These advantages are particularly noticeable if either an Fe-Ni alloy powder containing 5–70% Ni or an Fe-Mo alloy powder containing 20–70% Mo or both alloy powders are used.

The Fe-Ni alloy powder to be used in the present invention must contain at least 5% of Ni. If the Ni content is less than 5%, more than 20% of the Fe-Ni alloy powder has to be added to the feed powder in order to insure that the sinter as the final sintered product will have a Ni content of 1%. Since the Fe-Ni alloy powder is harder than ordinary iron powders, adding such a great amount of the Fe-Ni alloy powder will deteriorate the compressibility of the feed powder and the resulting sintered parts will have a lower density and, hence, a lower strength.

On the other hand, the upper limit of the Ni content in the Fe-Ni alloy powder is 70%. If the Ni content exceeds 70%, the concentration of Ni in the Ni-rich austenitic phase that is produced in the sintered parts will become so high that an excess austenitic phase will remain untransformed to martensite even if the sintered parts are deformed. This results in the loss of the advantage of enhancing strength and wear resistance compared to the conventional method of simply mixing a Ni powder with an iron-base powder.

The content of Mo in the Fe-Mo alloy powder is specified to lie in the range of 20–70%. If the Mo content is less than 20%, the addition of the Fe-Mo powder comprised of fine particles will increase, so the compressibility of the feed mixture will be lowered. If the Mo content exceeds 70%, the hardness of the Fe-Mo alloy powder is per se will increase, thereby lowering the compressibility of the feed mixture.

If either the Fe-Ni alloy powder containing 5–70% Ni is used as a Ni source or the Fe-Mo alloy powder containing 20–70% Mo is used as a Mo source or both alloy powders are used as a Ni and a Mo source, an appropriate Ni and/or Mo rich austenitic phase is dispersed in the sintered parts which, hence, has a higher strength than when an ordinary Ni powder and/or an ordinary Mo powder are mixed with an iron-base powder. Further, the amount of the Ni-rich austenitic phase in the sintered parts or the concentrations of Ni and/or Mo in that austenitic phase can be easily controlled by adjusting the Ni content of the Fe-Ni alloy powder and/or the Mo content of the Fe- Mo alloy powder or the particle size of those powders. Therefore, compared to the case of using a feed that is prepared by diffusion-alloying of an iron powder and a fine Ni powder and/or a fine Mo powder or by partially alloying of an iron powder with Mo, the method of the present invention enables sintered parts to be reinforced in an accurately controlled manner.

The iron-base powder to which the Fe-Ni alloy powder and/or the Fe-Mo alloy powder described above is to be adhered in accordance with the present invention may be of any type that is appropriately selected from among a pure iron powder, a Cr containing alloy powder, a Cr-Mn containing alloy powder, etc. depending on the specific use. A particularly preferred Cr-containing alloy powder is a prealloyed steel powder containing 0.08–5.0% Cr. If the Cr content is less than 0.08%, strict requirements for strength cannot be effectively met. If the Cr content exceeds 5.0%, the toughness of the sintered parts will decrease.

Various binders may be used in the present invention and they include not only the compounds used in the examples to be described below but also metal soaps such as tin stearate, aliphatic acids such as capric acid and oleic acid, aliphatic acid amides such as stearic acid amide and oleic acid amide, and low-molecular polyethylene.

In order to produce an iron-base powder composition comprising an iron-base powder to which the above-described Fe-Ni alloy powder and/or Fe-Mo alloy powder are adhered, either the Fe-Ni alloy powder or the Fe-Mo alloy powder or both are mixed with an iron-base powder, a C source, etc. in the presence of an added binder, whereby the alloy powder(s) are adhered to the iron-base powder via the binder. In order to improve the adhesion of the alloy powder(s) to the iron-base powder, the mixture is preferably heated in such a way that the binder is thermally melted. The binder to be used is preferably selected from among those listed in the preceding paragraph. The heating temperature is advantageously within the range of 80°–150° C. Below 80° C., a co-melt of the binders used will not form. Above 150° C., the co-melt will partly dissolve. Subsequently, the resulting composition is ground into particles, which are sieved for particle size adjustment.

The thus obtained iron-base powder composition is used for making an iron-base sintered material. To this end, the iron-base powder composition is formed into a desired shape by a suitable method, sintered and heat-treated as required. The forming, sintering and heat-treating steps may be performed by common methods. Forming is usually effected with a press at a pressure of 3–7 t/cm$^2$. Sintering is usually performed in an atmosphere such as Ammonia cracked gas, $N_2$ gas or $H_2$ gas at a temperature of 1100°–1300° C. The sintered composition is subjected to a heat treatment such as carburization, quenching or tempering for increasing the strength and toughness of the sintered parts.

EXAMPLE

The following examples are provided for the purpose of further illustrating the present invention but are in no way to be taken as limiting.

EXAMPLE A

A powder-metallurgical atomized iron powder having an average particle size of 75 μm was mixed with a powder-metallurgical graphite powder (C source) and the various Fe-Ni powders shown in Table 1. The Fe-Ni powders has an average particle size of 52 μm. Also the various Fe-Mo powders shown in Table 1 were used and they had average particle size of 11 μm.

Samples of iron-base powder composition were produced by the following procedures:

(1) An ordinary atomized pure iron powder was subjected to primary mixing with stearic acid;

(2) Then, an Fe-Ni powder and/or an Fe-Mo powder were added together with a graphite powder and zinc stearate and subjected to secondary mixing;

(3) During or after the secondary mixing (2), the mixture was heated to 120° C. so as to generate a co melt of stearic acid and zinc stearate;

(4) Then, the mixture was cooled to room temperature under tertiary mixing and the Fe-Ni powder and/or the Fe-Mo powder as well as the graphite powder were caused to adhere to the surface of the particles of the atomized iron powder by the binding force of the co-melt of stearic acid and zinc stearate; and (5) Further, the remainder of zinc stearate was added during cooling, followed by quaternary mixing.

After those steps for adhesion, the mixture was disintegrated into loose particles and sieved to prepare a powder composition.

The iron powder was mixed with the Fe-Ni powder and/or Fe-Mo powder as Ni and/or Mo sources in the proportions shown in Table 1. In each run, 0.2% graphite was added as a C source and 0.8% zinc stearate was added as a lubricant.

Thereafter, each sample of powder composition was pressed at 7 t/cm$^2$ into a cube measuring 55 mm×10 mm×10 mm. The cube was dewaxed by heating in $N_2$ gas at 600° C. for 30 temperature the cube was held at 60° C. for sintering. Thereafter, the sintered parts were heated at 920° C. for 60 min with 0.9% of carbon potential, followed by oil quenching at 60° C. and tempering at 180° C. for 120 min.

The thus heat-treated sintered parts were measured for size and density and a test piece having a diameter of 5 mm was machined from each sample and subjected to a tensile test to determine its tensile strength (at break). The samples were also subjected to the Ohgoshi test and the amount of wear for a wear distance of 20,000 m was determined by dripping an oil globule per second in air atmosphere. The test results are shown in Table 1, from which one can clearly see that the samples prepared in accordance with the present invention exhibited superb properties.

TABLE 1

| Run No. | Ni in Fe—Ni alloy powder (%) | Addition of Fe—Ni alloy powder (%) | Mo in Fe—Mo alloy powder (%) | Addition of Fe—Mo alloy powder (%) | Sintered and heat-treated parts: Ni content (%) | Mo content (%) | Density (g/cm$^3$) | Tensile strength (kgf/mm$^2$) | Wear volume (mm$^3$) |
|---|---|---|---|---|---|---|---|---|---|
| Comparison 1 | 4.5 | 22.2 | | | 1.0 | | 6.95 | 89 | $6.7 \times 10^{-1}$ |
| Invention 1 | 5.3 | 18.9 | | | 1.0 | | 7.08 | 118 | $3.4 \times 10^{-3}$ |
| Invention 2 | 10.2 | 9.8 | | | 1.0 | | 7.13 | 131 | $4.1 \times 10^{-3}$ |
| Comparison 2 | 100.0 | 1.0 | | | 1.0 | | 7.12 | 92 | $5.5 \times 10^{-1}$ |
| Invention 3 | 51.0 | 19.6 | | | 10 | | 7.17 | 137 | $7.2 \times 10^{-2}$ |
| Invention 4 | 68.2 | 14.7 | | | 10 | | 7.26 | 120 | $9.1 \times 10^{-2}$ |
| Comparison 3 | 74.0 | 13.5 | | | 10 | | 7.31 | 91 | $5.6 \times 10^{-0}$ |
| Comparison 4 | 100 | 10.0 | | | 10 | | 7.32 | 91 | $6.6 \times 10^{-0}$ |
| Comparison 5 | | | 15.2 | 6.6 | | 1.0 | 6.92 | 93 | $2.7 \times 10^{-1}$ |
| Invention 5 | | | 20.4 | 4.9 | | 1.0 | 7.11 | 121 | $6.2 \times 10^{-2}$ |
| Invention 6 | | | 62.3 | 1.6 | | 1.0 | 7.10 | 128 | $3.3 \times 10^{-2}$ |
| Invention 7 | | | 70.7 | 1.4 | | 1.0 | 7.10 | 132 | $1.9 \times 10^{-2}$ |
| Comparison 7 | | | 75.6 | 1.3 | | 1.0 | 6.90 | 99 | $8.2 \times 10^{-1}$ |
| Invention 8 | 5.3 | 18.9 | 20.4 | 4.9 | 1.0 | 1.0 | 7.03 | 131 | $6.9 \times 10^{-2}$ |

*Measured by the Ohgoshi method: Wear dustance = 20,000 m

EXAMPLE B

A powder-metallurgical Cr-containing alloy steel powder (1% Cr) having an average particle size of 81 μm was mixed with a powder-metallurgical graphite powder as a C source, as well as either an Fe-Ni powder (Ni source) or an Fe-Mo powder (Mo source) or both in the proportions shown in Table 2. The Fe-Ni and Fe Mo powders as Ni and Mo sources were the same as those used in Example A. The ingredients were mixed by either the "simple mixing" method or the "thermal mixing" method. In the "thermal mixing" method, the Cr-containing alloy steel powder, the Fe Ni powder and/or the Fe-Mo powder and the graphite powder were mixed with 0.2 wt % each of two binders (stearic acid monoamide and ethylenebisstearic acid amide) under heating at 120° C. for 20 min. Following the above-described treatment for adhesion by means of binders, the mixture was disintegrated into loose particles and sieved to prepare a powder composition. In the "simple mixing" method, the ingredients were simply mixed together in the absence of binders.

Subsequently, test pieces were prepared as in Example A from both the simple-mixed powders and the powder compositions of the present invention, and the heat-treated sintered parts were determined for the standard deviation of scattering in the dimensional distortion and the tensile strength. The results are shown in Table 2. It was evident that good dimensional change stability, high strength and high wear resistance could be attained by adhering the Fe-Ni alloy powder and/or the Fe-Mo alloy powder to the surface of the particles of an iron-base powder by means of binders.

TABLE 2

| Run No. | Ni in Fe—Ni alloy powder (%) | Addition of Fe—Ni alloy powder (%) | Mo in Fe—Mo alloy powder (%) | Addition of Fe—Mo alloy powder (%) | Dimensional precision (%) | Sintered and heat-treated parts: Ni content (%) | Mo content (%) | Tensile strength (kgf/mm$^2$) | Wear volume (mm$^3$) |
|---|---|---|---|---|---|---|---|---|---|
| Invention 1 | 5.3 | 18.9 | | | 0.0062 | 1.0 | | 142 | $6.7 \times 10^{-3}$ |
| Comparison 1 | | | | | 0.0093 | | | 123 | $7.3 \times 10^{-1}$ |
| Invention 2 | 10.2 | 9.8 | | | 0.0060 | 1.0 | | 154 | $1.8 \times 10^{-3}$ |
| Comparison 2 | | | | | 0.0089 | | | 129 | $6.1 \times 10^{-1}$ |
| Invention 3 | 51.0 | 19.6 | | | 0.0053 | 10 | | 158 | $4.2 \times 10^{-3}$ |
| Comparison 3 | | | | | 0.0092 | | | 128 | $1.7 \times 10^{-0}$ |
| Invention 4 | 68.2 | 14.7 | | | 0.0058 | 10 | | 149 | $3.9 \times 10^{-2}$ |
| Comparison 4 | | | | | 0.0091 | | | 128 | $1.1 \times 10^{-0}$ |
| Invention 5 | | | 20.4 | 4.9 | 0.0058 | | 1.0 | 131 | $1.3 \times 10^{-3}$ |
| Comparison 5 | | | | | 0.0091 | | | 111 | $6.8 \times 10^{-1}$ |
| Invention 6 | | | 62.3 | 1.6 | 0.0051 | | 1.0 | 139 | $1.1 \times 10^{-3}$ |
| Comparison 6 | | | | | 0.0086 | | | 112 | $5.7 \times 10^{-1}$ |
| Invention 7 | 5.3 | 18.9 | 20.4 | 4.9 | 0.0053 | 1.0 | 1.0 | 142 | $3.7 \times 10^{-3}$ |
| Comparison 7 | | | | | 0.0087 | | | 119 | $2.9 \times 10^{-1}$ |

Notes:
Simple mixing was adopted in Comparison Runs 1-7, and thermal mixing was used in Invention Runs 1-7.

EXAMPLE C

A powder-metallurgical Cr-containing alloy steel powder with an average particle size of about 80 μm that contained 0.05%, 4.5% or 5.5% Cr was thermally mixed with 0.2% of a powder-metallurgical graphite powder (C source) and an Fe-Mo powder (Mo source) as in Example A. Thereafter, test pieces were prepared as in Example A and the heat-treated sintered parts were determined for their tensile strength and Charpy impact value (without notch). The results are shown in Table 3, from which one can see that sintered parts of superb strength and toughness were obtained within the scope of the present invention.

TABLE 3

| Run No. | Cr in prealloy steel powder (%) | Mo in Fe—Mo alloy powder (%) | Addition of Fe—Mo alloy powder (%) | Sintered and heat-treated parts: Mo content (%) | Tensile Strength ($kgf/mm^2$) | Charpy impact value ($kgf \cdot m/cm^2$) |
|---|---|---|---|---|---|---|
| Comparison 1 | 0.05 | 20.4 | 4.9 | 1.0 | 122 | 4.8 |
| Comparison 2 | 5.5 | 20.4 | 4.9 | 1.0 | 157 | 1.7 |
| Invention 1 | 4.5 | 20.4 | 4.9 | 1.0 | 154 | 3.5 |

In accordance with the present invention, an improved iron-base powder composition for use in powder metallurgy can be obtained that has high strength, high toughness, good dimensional change stability and high wear resistance. Using this powder composition, iron-based sintered materials can be easily produced.

What is claimed is:

1. An iron-base powder composite for use in powder metallurgy in a form having an iron-based core, wherein particles of either an Fe-Ni alloy powder containing 5–70 wt % Ni or an Fe-Mo alloy powder containing 20–70 wt % Mo or both such alloy powders are bound to the surface of the iron-based core with a binder or binders, said Fe-Ni alloy powder and/or said Fe-Mo alloy powder being present in such an amount that the Ni and/or Mo contents of the resulting sintered parts are within the range of 1–10 wt % Ni and/or 0.5–10 wt % Mo.

2. An iron-base powder composite according to claim 1 wherein said iron-base core is a pure iron or an alloy steel.

3. An iron-base powder according to claim 2, wherein the alloy steel contains 0.2–1.0% by weight of carbon.

4. An iron-base powder according to claim 2 or 3 wherein said alloy steel is a prealloyed steel containing 0.08–5.0% by weight of Cr.

5. An iron-base powder composite for use in powder metallurgy in a form having a substantially pure iron core, wherein particles of either an Fe-Ni alloy powder containing 5–70 wt % Ni or an Fe-Mo alloy powder containing 20–70 wt % Mo or both such alloy powders and 0.2–1.0 wt % of graphite powder are bound to the surface of the substantially pure iron core with a binder or binders, said Fe-Ni alloy powders and/or said powders being present in such an amount that the Ni and/or Mo contents of the resulting sintered parts are within the ranges of 1–10 wt % Ni and/or 0.5–10 wt % Mo.

* * * * *

UNITED STATES PATENT AND TRADEMARK OFFICE

CERTIFICATE OF CORRECTION

PATENT NO. : 5,308,702

DATED : May 3, 1994

INVENTOR(S) : Osamu Furukimi et al

It is certified that error appears in the above-indentified patent and that said Letters Patent is hereby corrected as shown below:

In column 6, line 53, after "30" insert --min; the temperature was raised in $N_2$ gas to 1180°C, at which--.

In column 10, line 27 (claim 5), after "said", second occurrence, insert --Fe-Mo alloy--.

Signed and Sealed this

Ninth Day of August, 1994

*Attest:*

*Attesting Officer*

Bruce Lehman

BRUCE LEHMAN

*Commissioner of Patents and Trademarks*